US008375746B2

(12) United States Patent
Picken et al.

(10) Patent No.: US 8,375,746 B2
(45) Date of Patent: Feb. 19, 2013

(54) FRAMELESS SPILL-SAFE SHELF

(75) Inventors: Alan D. Picken, Manitou Beach, MI (US); Ye Cailin, Shanghai (CN)

(73) Assignee: Clarion Technologies, Inc., Holland, MI (US)

( * ) Notice: Subject to any disclaimer, the term of this patent is extended or adjusted under 35 U.S.C. 154(b) by 1071 days.

(21) Appl. No.: 12/173,207

(22) Filed: Jul. 15, 2008

(65) Prior Publication Data

US 2009/0091230 A1 Apr. 9, 2009

Related U.S. Application Data

(60) Provisional application No. 60/949,925, filed on Jul. 16, 2007.

(51) Int. Cl.
*C03B 23/025* (2006.01)

(52) U.S. Cl. ..... 65/106

(58) Field of Classification Search ..... 65/106
See application file for complete search history.

(56) References Cited

U.S. PATENT DOCUMENTS

| | | | | |
|---|---|---|---|---|
| 2,871,623 | A * | 2/1959 | Marini | 65/23 |
| 4,737,182 | A * | 4/1988 | Fecik et al. | 65/106 |
| 5,878,902 | A * | 3/1999 | Cowan et al. | 220/1.5 |
| 6,113,206 | A | 9/2000 | Melson et al. | |
| 6,713,180 | B1 * | 3/2004 | Torr et al. | 428/410 |
| 2005/0017143 | A1 * | 1/2005 | Bronsink et al. | 248/250 |
| 2008/0000267 | A1 * | 1/2008 | Fukami et al. | 65/106 |
| 2008/0012459 | A1 * | 1/2008 | Picken et al. | 312/408 |
| 2009/0051257 | A1 * | 2/2009 | Picken et al. | 312/408 |
| 2009/0084914 | A1 * | 4/2009 | Picken et al. | 248/206.5 |
| 2011/0100060 | A1 * | 5/2011 | Tetlow | 65/107 |
| 2011/0129693 | A1 * | 6/2011 | Isono | 428/846.9 |

FOREIGN PATENT DOCUMENTS

| | | | |
|---|---|---|---|
| EP | 0671593 | A2 | 9/1995 |
| EP | 1099917 | A1 | 5/2001 |
| JP | 2006-181936 | A | 7/2006 |
| WO | 2006/044641 | A2 | 4/2006 |

OTHER PUBLICATIONS

International Search Report and Written Opinion from corresponding Patent Cooperation Treaty Application No. PCT/US2008/070111, dated Jan. 19, 2009, which corresponds to U.S. Appl. No. 12/173,207.

* cited by examiner

*Primary Examiner* — Matthew Daniels
*Assistant Examiner* — Russell Kemmerle, III
(74) *Attorney, Agent, or Firm* — Gardner, Linn, Burkhart & Flory, LLP

(57) ABSTRACT

A formed glass shelf is provided having a central region with an upper planar surface and a curved perimeter region surrounding the central region, which has an edge. The curved perimeter region is non-coplanar with the central region, and the edge is offset in a range of about 2 mm to 6 mm from the upper planar surface of the central region to contain spills on the shelf. A method is provided for slump-forming the shelf, including slump-forming an oversized blank and removing an outermost portion to achieve the finished size.

13 Claims, 4 Drawing Sheets

FRAMELESS SPILL-SAFE SHELF

CROSS REFERENCE TO RELATED APPLICATION

The present application claims the benefit of U.S. provisional application, Ser. No. 60/949,925, filed Jul. 16, 2007, which is hereby incorporated herein by reference in its entirety.

FIELD OF THE INVENTION

The present invention is directed to shelving and, more specifically, to refrigerator or freezer shelving capable of containing spills.

BACKGROUND OF THE INVENTION

Shelves are used to increase the useable space in a refrigerator or freezer, and are often made of glass or other easily cleanable and/or sanitizable material. To prevent spills (especially liquid spills) from overflowing onto surfaces located below, glass refrigerator shelving may be framed with a raised ridge or lip made of metal or plastic, for example. However, framing glass shelving with metal or plastic ridges may significantly reduce the useable surface area of the shelves and detract from the interior appearance of the refrigerator or freezer.

To improve the aesthetic and storage-efficiency aspects of glass shelving, it may be desirable to form a raised lip around the perimeter of a given glass shelf in a slump-forming process, for example. The slump-forming process typically involves heating glass that is placed over a contoured mold until the glass reaches a temperature at which the glass will bend under the force of gravity over a period of time, but without melting. An operator may adjust the temperature and time according to glass composition, thickness, and mold shape.

However, typical slump-forming methods require a relatively wide region around the perimeter of the shelf to be formed into a lip by the slump-forming process. Because the use of a relatively wide raised lip on a refrigerator shelf may significantly reduce the useable surface area on which articles may be placed, the typical slump-forming process has not been suitable for manufacturing frameless spill-safe shelves for refrigerators and freezers. Therefore, there is a need to provide a space-efficient spill-safe shelf with an aesthetically desirable frameless appearance.

SUMMARY OF THE INVENTION

Accordingly, the present invention provides a frameless glass shelf that is adapted to be installed in a refrigerator or freezer and which is capable of containing liquids that are spilled thereon, while maintaining a relatively large surface area on which objects may be stored.

According to one form of the present invention, a formed glass shelf includes a central region and a perimeter region. The central region is substantially planar and the perimeter region is curved and is disposed about the planar central region. The curved perimeter region is non-coplanar with a planar upper surface of the central region. The curved perimeter region has an edge that is offset about 6 mm or less from the planar upper surface of the central region.

In one aspect, the glass shelf is used in combination with a refrigerator or a freezer.

In another aspect, the edge is offset in a range of about 2 mm to 5 mm from the planar upper surface of the central region.

According to yet another aspect, the glass shelf is a substantially rectangular shaped shelf having four edges, and may have four rounded corners.

In yet another aspect, the curved perimeter region is in a range of about 5 mm to 20 mm in width.

According to another form of the present invention, a method is provided for forming a glass sheet, the method including providing a substantially planar glass sheet and a female mold for forming the glass sheet. The female mold has a substantially planar central portion with a planar upper surface and an upwardly-curved perimeter portion defining an edge that is offset about 10 mm or more from the planar upper surface of the central region. The glass sheet is positioned atop the female mold such that the glass sheet is above the central portion and the perimeter portion of the female mold. The glass sheet is heated to an elevated temperature and maintained at the elevated temperature until the glass sheet substantially conforms to the mold, the glass sheet consequently having a substantially planar central portion and an upwardly-curved perimeter portion defining an edge that is offset about 10 mm or more from the planar upper surface of the central region of the glass sheet. A portion is removed from the curved perimeter portion of the glass sheet to form a trimmed edge, wherein the trimmed edge is in a range of 2 mm to 6 mm, or less, offset from the planar upper surface of the central region of the glass sheet.

In one aspect, the method further includes annealing the glass sheet after the glass sheet has substantially conformed to the mold.

According to another aspect, the method further includes tempering the glass sheet after the removing of a portion from the curved perimeter portion of the glass sheet. In a further aspect, the edge is ground to provide a finished edge before the tempering.

According to yet another aspect, maintaining the glass sheet at the elevated temperature includes maintaining the glass sheet at an elevated temperature in a range of 600-800 degrees C. The maintaining may include maintaining the glass sheet at an elevated temperature for a time period of about 1-3 hours.

According to a further aspect, the female mold and the glass sheet are conveyed while maintaining the glass sheet at the elevated temperature.

According to a still further aspect, a plurality of the female molds and the glass sheets are sequentially conveyed while maintaining the glass sheets at an elevated temperature.

Therefore, the present invention provides a glass shelf that is supportable in a refrigerator or freezer or other storage area, and which is capable of containing spilled or leaked liquids or solids on the shelf without the use of a separate frame or ridge around the perimeter of the shelf. This functionality is achieved while reserving a substantially large flat or planar portion of the shelf area for the storage of articles thereon. Further, the present invention provides a method for forming the glass shelf of the invention.

These and other objects, advantages, purposes and features of the present invention will become apparent upon review of the following description in conjunction with the drawings.

DETAILED DESCRIPTION OF THE PREFERRED EMBODIMENT

Figure 1:
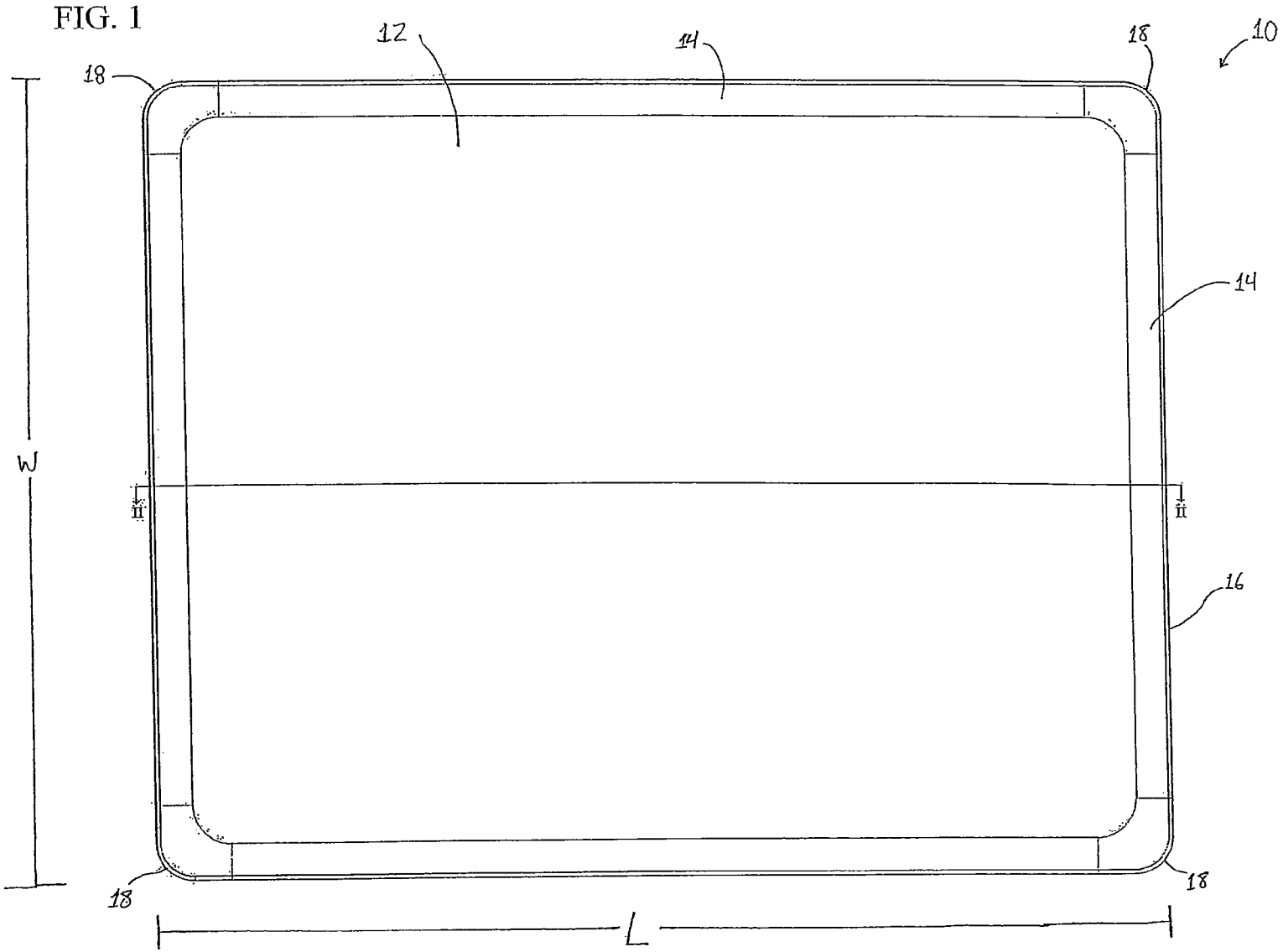
FIG. 1 is a top, plan view of a shelf of the present invention.

Referring to FIG. 1, the numeral 10 generally designates a frameless spill-safe shelf of the present invention. As will be more fully described below, shelf 10 is adapted to be supported in a refrigerator or freezer or other storage area, and to contain spills without the use of a frame, while maintaining a relatively large useable surface area.

Figure 2:
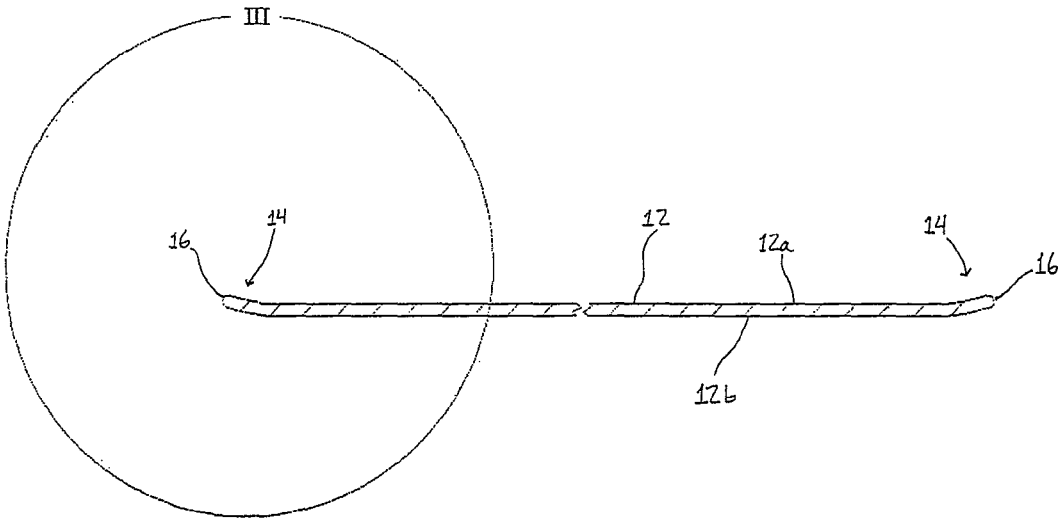
FIG. 2 is a cross-section view of the shelf of FIG. 1 and taken along section line II.
Figure 3:
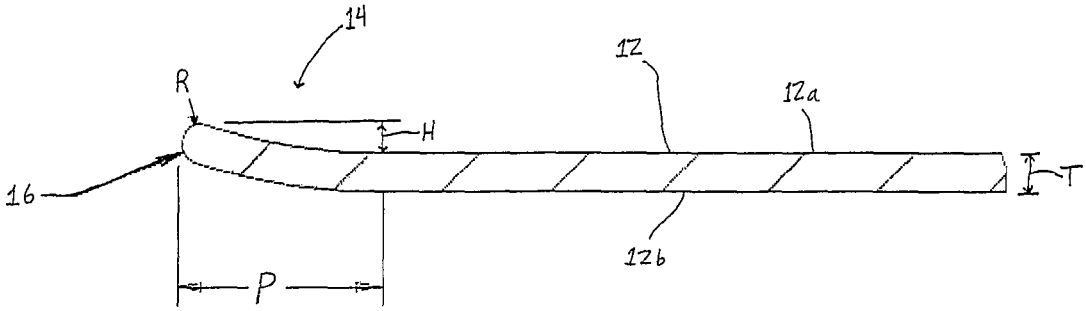
FIG. 3 is an enlarged cross-section view of the shelf of FIG. 1, taken along section III of FIG. 2.

Shelf 10 includes a substantially planar central region 12 and a curved outer or perimeter region 14. Perimeter region 14 further defines an outer edge 16 around the entirety of shelf 10. Planar central region 12 has a top planar surface 12*a* for supporting articles such as food items, and a bottom surface 12*b* on which shelf 10 may be supported (FIGS. 2 and 3).

Figure 5:
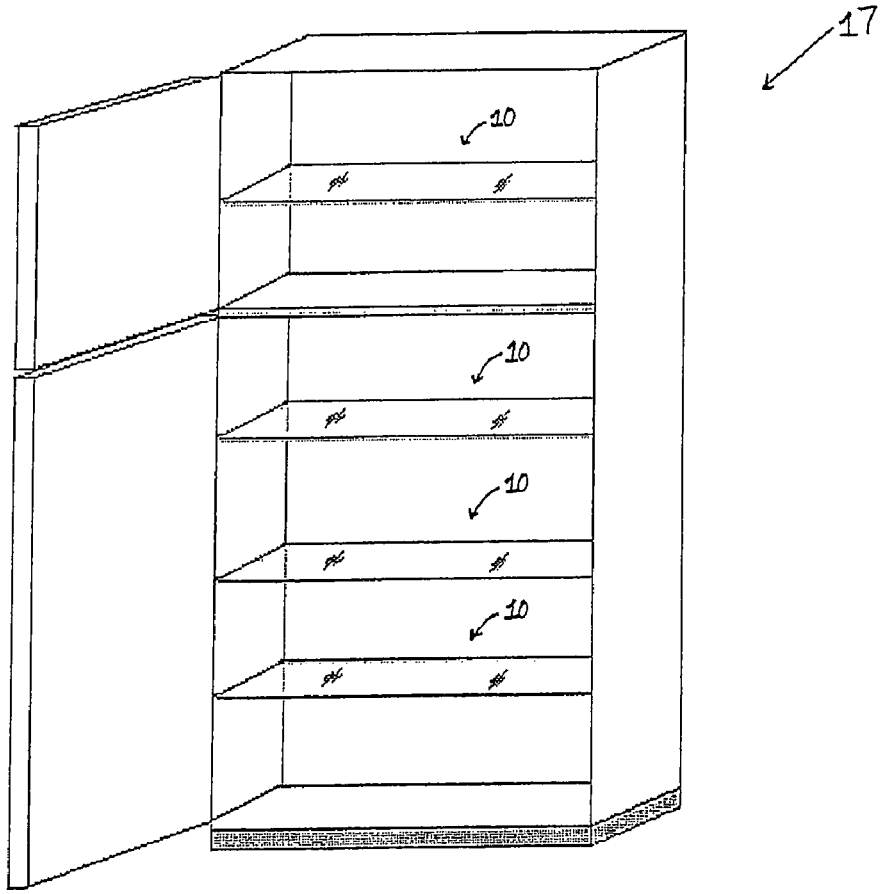
FIG. 5 is a perspective view of a combination freezer-refrigerator incorporating shelves of the present invention.

It will be appreciated that shelf 10 may be sized with an overall length L and overall width W (FIG. 1) to fit substantially any opening in a storage area such as a freezer or refrigerator 17 (FIG. 5) or a storage cabinet, for example. In the present invention, curved perimeter region 14 typically has a width P (FIG. 3) in a range of about 5-20 millimeters (mm) and preferably in a range of about 8 mm to 10 mm, and optionally about 9 mm. Further, curved perimeter region 14 curves upwardly to a vertical height H in a range of about 2 mm to 6 mm, or less, above top surface 12*a* of planar central region 12 (FIGS. 2 and 3). Alternatively, height H may be in a range of about 2 mm to 5 mm or about 5 mm. In this manner, the lip formed by curved perimeter region 14 provides a spill barrier while still providing planar support surface 12 that is sufficiently large for storing objects thereon.

The dimensions of the shelf itself may vary depending on the application. For example, shelf 10 may have a thickness T in a range of about 2 mm to 6 mm and more typically in range of about 3 mm to 5 mm, where thickness T remains substantially constant throughout planar central region 12 and curved perimeter region 14. Optionally, shelf 10 may include rounded corners 18 to facilitate the handling, installation, and aesthetic appearance of shelf 10 (FIG. 1). It will be appreciated by those skilled in the art that the dimensions of shelf 10, including overall width W, overall length L, and thickness T may be substantially varied to suit the needs of a particular application without departing from the spirit and scope of the present invention.

Figure 4A:
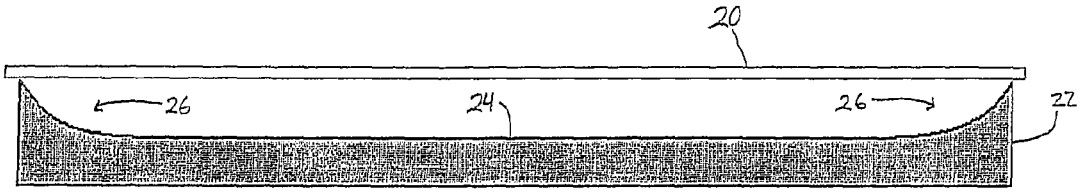
FIG. 4A is a cross-section view of a glass sheet positioned above a female mold.

Further, a method is provided for forming shelf 10 from a glass sheet 20 (FIG. 4A) that forms a spill lip at one or more sides of the shelf while still maintaining a substantially large flat or planar portion of the shelf area for the storage of articles thereon. A female mold 22 is provided with a substantially planar top surface 24 and curved edge portions 26 that extend to about 10 mm or more above planar top surface 24. Planar glass sheet 20 is sized to rest upon or overhang curved edge portions 26 of female mold 22, and is placed atop female mold 22 in preparation for slump-form processing in an oven (not shown).

Figure 4B:
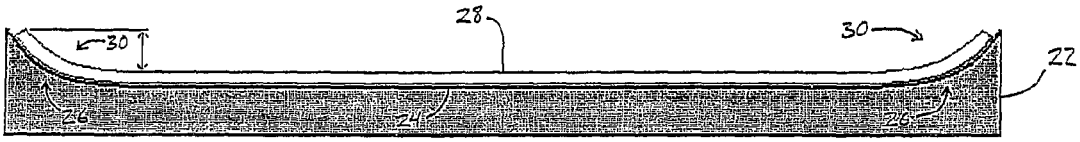
FIG. 4B is a cross-section view of the glass sheet and female mold of FIG. 4A, wherein the glass sheet has conformed to the female mold.
Figure 4C:
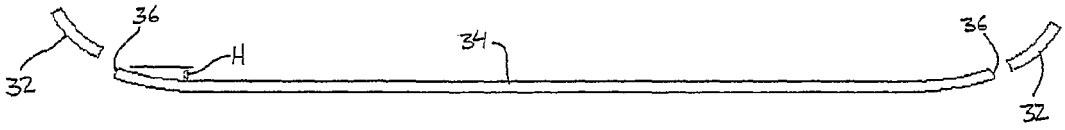
FIG. 4C is a cross-section view of the glass sheet of FIG. 4B, wherein outermost portions have been removed.

During the slump-forming process for forming shelf 10, sheet 20 is maintained at an elevated temperature where the glass sheet is heated to a state at which it conforms to the mold 22 for about one or more hours and, optionally, for about two or more hours, at a temperature in a range of about 600 to 800 degrees C., and optionally in a range of 650 to 750 degrees C., so that glass sheet 20 conforms to mold 22 to form an oversized blank 28 having a relatively large curved perimeter region 30 (FIG. 4B). The blank 28 is then annealed by slowly decreasing the applied temperature, after which outermost portions 32 of large curved perimeter region 30 are removed, such as by cutting or grinding (FIG. 4C). The removal of outermost portions 32 results in a formed blank 34 that is then tempered and finished or ground (such as by pencil-grinding) at cut edges 36, leaving outer edge 16 at an edge height H above top surface 12*a* of planar inner region 12.

Accordingly, a frameless spill-safe shelf may be formed by slump-forming an oversized blank having a relatively large curved perimeter region. The perimeter region is cut to an appropriate size resulting in a curved perimeter region around the planar inner region. The planar inner region has a relatively large surface area and the curved perimeter region enables the shelf to substantially contain liquids or spillable solids thereon.

Although described in reference to a frameless shelf and the shelf being formed with all four sides being curved upwardly to form a perimeter lip, it should be understood that the shelf may be formed with a single side that has a lip, or two or three sides each with a lip. Optionally, the shelf may be formed is substantially any polygon shape or curved shape having substantially any number of sides. Therefore, it should be understood that embodiments of the present invention may have any number of sides and may be combined with a conventional frame on one, two, or three sides, depending on the desired look of the shelf.

Changes and modifications to the specifically described embodiments may be carried out without departing from the principles of the present invention, which is intended to be limited only by the scope of the appended claims, as interpreted according to the principles of patent law including the doctrine of equivalents.

The invention claimed is:

1. A method of forming a glass sheet, said method comprising:

providing a glass sheet having a central portion with an upper planar surface;

providing a female mold having a substantially planar central portion and an upwardly-curved perimeter portion defining an edge that is offset about 10 mm or more from said central portion;

positioning the glass sheet atop the female mold such that the glass sheet is above the central portion and the perimeter portion of the female mold, with the glass sheet initially supported at the edge of the perimeter portion of the female mold;

heating the glass sheet to an elevated temperature;

maintaining the glass sheet at the elevated temperature until the glass sheet slumps to substantially conform to the mold under force of gravity, with the central portion of the glass sheet contacting the substantially planar central portion of the female mold to provide the glass sheet with a central portion having an upper planar surface and an upwardly-curved perimeter portion defining an edge that is offset about 10 mm or more from the upper planar surface of the central portion of the glass sheet; and after the glass sheet has substantially conformed to the mold, removing a portion from the curved perimeter portion of the glass sheet to form a trimmed edge, wherein the trimmed edge is offset in a range of about 6 mm to 2 mm from the upper planar surface of the central portion of the glass sheet.

2. The method of claim 1, further comprising annealing the glass sheet after the glass sheet substantially conforms to the mold.

3. The method of claim 1, further comprising tempering the glass sheet after said removing.

4. The method of claims 1, further comprising grinding the trimmed edge before said tempering.

5. The method of claim 1, wherein said maintaining the glass sheet at the elevated temperature includes maintaining the glass sheet at an elevated temperature in a range of about 600 degrees C. to 800 degrees C.

6. The method of claim 1, wherein said maintaining includes maintaining the glass sheet at an elevated temperature for about one hour or more.

7. The method of claim 6, wherein said maintaining includes maintaining the glass sheet at an elevated temperature for about two hours or more.

8. The method of claim 1, further comprising:

conveying the female mold and the glass sheet while maintaining the glass sheet at the elevated temperature.

9. The method of claim 8, further comprising:

providing a plurality of the female molds and the glass sheets; and sequentially conveying the female molds and the glass sheets while maintaining the glass sheets at an elevated temperature.

10. The method of claim 1, wherein said removing a portion from the curved perimeter portion of the glass sheet leaves the trimmed edge offset about 5 mm from the upper planar surface of the central portion of the glass sheet.

11. A method of forming a glass sheet, said method comprising:

providing a glass sheet having a central portion with an upper planar surface;

providing a female mold having a substantially planar central portion and an upwardly-extending perimeter portion defining a rim extending around the central portion;

positioning the glass sheet atop the female mold such that the glass sheet is supported by the rim above the central portion and the perimeter portion of the female mold;

heating the glass sheet to an elevated temperature;

maintaining the glass sheet at the elevated temperature until the glass sheet slumps under force of gravity to substantially conform to the mold, the glass sheet consequently having a central portion with an upper planar surface and a perimeter portion defining a rim; and after said glass sheet substantially conforms to the mold, trimming away a portion of the rim of the glass sheet to leave a finished rim edge that is offset from the upper planar surface of the central portion of the glass sheet in a range of about 6 mm to 2 mm.

12. The method of claim 11, wherein said trimming away a portion of the rim of the glass sheet leaves the finished rim edge offset by about 5 mm from the upper planar surface of the central portion of the glass sheet.

13. The method of claim 11, wherein said heating the glass sheet to an elevated temperature comprises heating the glass sheet to a temperature of about 600 degrees C. to 800 degrees C.

* * * * *